United States Patent [19]

Wright

[11] 3,942,802

[45] Mar. 9, 1976

[54] GOLFING AID

[76] Inventor: Gary C. Wright, 1450 E. Bates Ave., Denver, Colo. 80210

[22] Filed: Sept. 23, 1974

[21] Appl. No.: 508,234

[52] U.S. Cl. ..... 273/186 C; 273/192

[51] Int. Cl.[2] ..... A63B 69/36

[58] Field of Search ..... 273/186, 191, 192, 183

[56] References Cited

UNITED STATES PATENTS

| | | | |
|---|---|---|---|
| 3,301,561 | 1/1967 | Kaiser | 273/192 X |
| 3,375,010 | 3/1968 | Panza | 273/191 R |
| 3,460,837 | 8/1969 | Cassa | 273/186 C |
| 3,482,838 | 12/1969 | Gibson et al. | 273/191 R |

*Primary Examiner*—George J. Marlo
*Attorney, Agent, or Firm*—Burton, Crandell & Polumbus

[57] ABSTRACT

A golfing aid for improving a golfer's swing plane and putting stroke includes a base member with an elongated rod connected to the base member by a pivotal support arm wherein the elongated rod is movable between a first position wherein it inclines upwardly and outwardly away from the golfer in a forward direction and a second position wherein it lies parallel to the ground in closely spaced relationship therewith. In the first position, the elongated rod visually suggests an inside-out path of movement for the club head and physically prevents an outside-in path so that the golfer is assisted in establishing the proper swing plane. In the second position the elongated rod can be pointed toward a cup on a practice putting green to assist in developing a putting stroke wherein the putter is maintained in close relationship to the ground throughout the entire stroke as is desirable for consistent putting.

8 Claims, 9 Drawing Figures

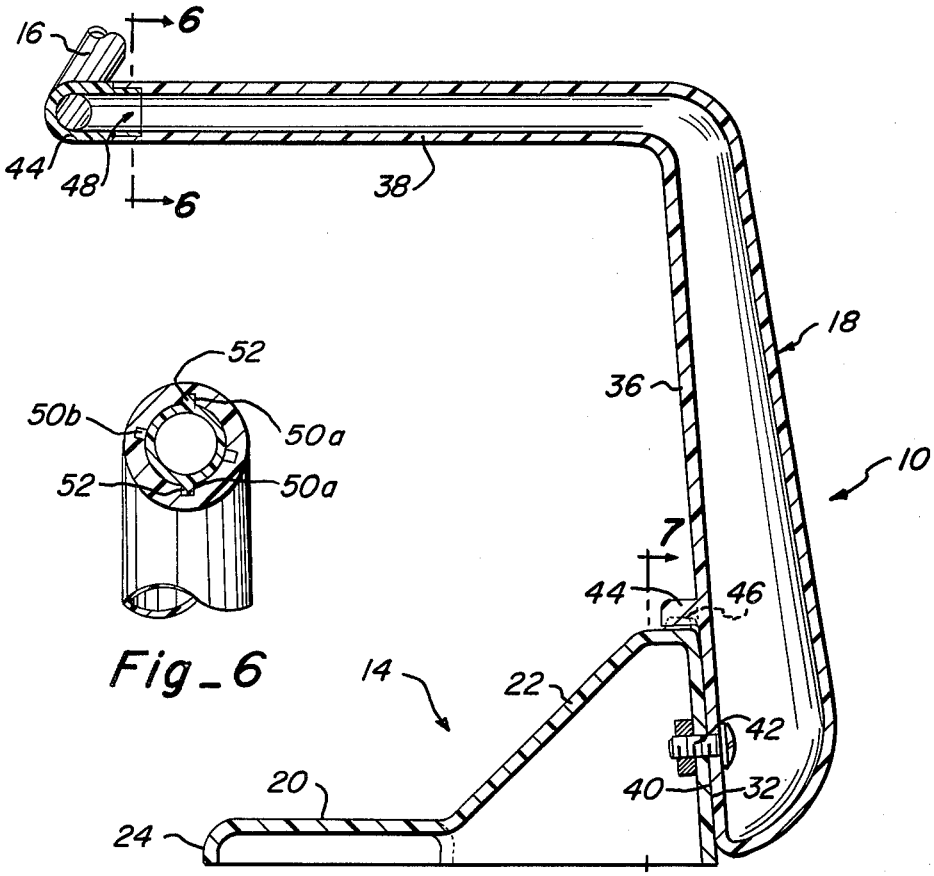
Fig_5
Fig_6
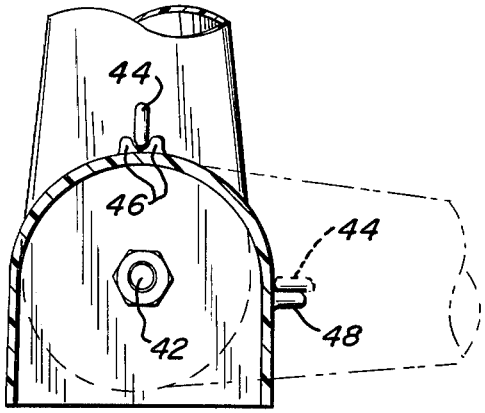
Fig_7
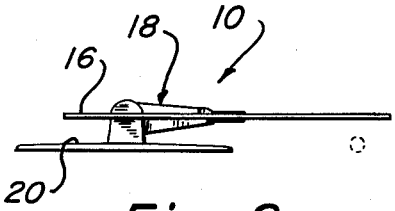
Fig_8
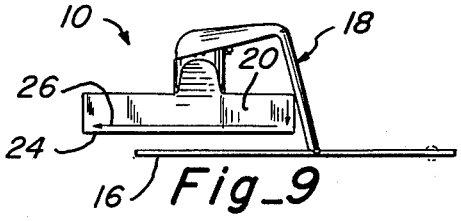
Fig_9

GOLFING AID

BACKGROUND OF THE INVENTION

The present invention relates generally to golfing aids and more particularly to a golfing aid which assists in developing a desired inside-out golf swing for tee-to-green shots and for developing a putting stroke wherein the putter blade remains in close relationship to the putting surface and in perpendicular relationship to the intended line of putt throughout the putting stroke.

It is believed by most golf authorities that a proper golf swing effects an inside-out path of movement of the club head prior to impact with the ball for hitting shots between the tee and the green. An inside-out path of movement being defined as a path which is directed outwardly away from the golfer in a forward direction. As is common, however, with a large percentage of golfers, the path of movement of the club head passes along an outside-in path prior to impact with the ball which causes the shot to be pulled to the left of the target (for a right-handed golfer) or to impart a spin to the ball which causes the ball to slice to the right of the target. In either instance it is difficult to consistently get the ball to the desired target.

In another facet of the golf game, namely putting, it is desirable to maintain the putter head in closely adjacent relationship with the putting surface and perpendicular to the intended line of putt throughout the entire stroke so that the head makes uniform solid contact with the ball resulting in more consistent results.

While the inside-out club head movement is desirable for tee-to-green shots and the maintenance of the putter head in close relationship to the ground and perpendicular to the intended line of putt for putting, to applicant's knowledge, there have been no devices developed which adequately assist a golfer is obtaining these objectives and particularly one device which adequately assists the golfer in obtaining both objectives.

OBJECTS OF THE INVENTION

Accordingly, it is an object of the present invention to provide a new and improved golfing aid which assists a golfer in developing a golf swing wherein the club head follows an inside-out path of movement prior to impact with the ball.

It is another object of the present invention to provide an apparatus for assisting a golfer in developing a putting stroke wherein the putter blade remains in closely adjacent relationship with the putting surface and in perpendicular relationship with the intended line of putt throughout the entire stroke.

It is another object of the present invention to provide a new and improved golfing aid which assists a golfer in establishing a golf swing wherein the club head follows an inside-out path of movement prior to impact with the ball and also assists the golfer in establishing a putting stroke wherein the putter blade remains in closely adjacent relationship with the putting surface and in perpendicular relationship with the intended line of putt throughout the stroke.

It is still another object of the present invention to provide a golfing aid which helps establish a mental image for the golfer suggesting an inside-out swing path for the club head prior to impact with the ball and which physically prevents an outside-in path of movement of the club head prior to impact with the ball.

Other objects, advantages and capabilities of the present invention will become more apparent as the description proceeds taken in conjunction with the accompanying drawings.

SUMMARY OF THE INVENTION

The golfing aid of the present invention is very simple in construction so as to be economical to manufacture and yet its utilitarian function is diversified such that it can not only be used to develop a proper golf swing for tee-to-green shots but can also be used for developing a proper putting stroke for most consistent putting.

The device includes a base adapted to be supported upon the ground and an elongated rod which is connected to the base by a pivotal support arm so that the rod can be selectively moved between a first position wherein it assists in developing a proper golf swing and a second position where it assists in developing a proper putting stroke. In the first position, the elongated rod is supported so that it is inclined upwardly and outwardly away from the golfer in a forward direction so as to suggest an inside-out path of movement for the club head prior to impact with the ball and so as to physically contact the golf club if the club head is moved along an outside-in path of movement prior to impact with the ball. In the second position, the elongated rod is retained in closely adjacent spaced parallel relationship with the putting surface so that the putter blade can be moved beneath the rod in perpendicular relationship with the intended line of putt but cannot be elevated away from the putting surface without engaging the rod.

It will be appreciated that in the first position of the elongated rod, the golfer is assisted in developing a desired inside-out path of movement for the club head prior to impact with the ball and in the second position the golfer is assisted in developing a putting stroke wherein the putter blade remains in closely spaced relationship with the putting surface in perpendicular relationship with the intended line of putt throughout the entire stroke.

BRIEF DESCRIPTION OF THE DRAWINGS

FIG. 5 is a vertical section taken along line 5—5 of FIG. 3.

FIG. 6 is an enlarged section taken along line 6—6 of FIG. 5.

FIG. 7 is a section taken along line 7—7 of FIG. 5.

FIG. 8 is a side elevation of the golfing aid of FIG. 1 with the elongated rod of the device in position to assist in putting.

FIG. 9 is a top plan view of the golfing aid as it is shown in FIG. 8.

DESCRIPTION OF THE PREFERRED EMBODIMENTS

Figure 1:
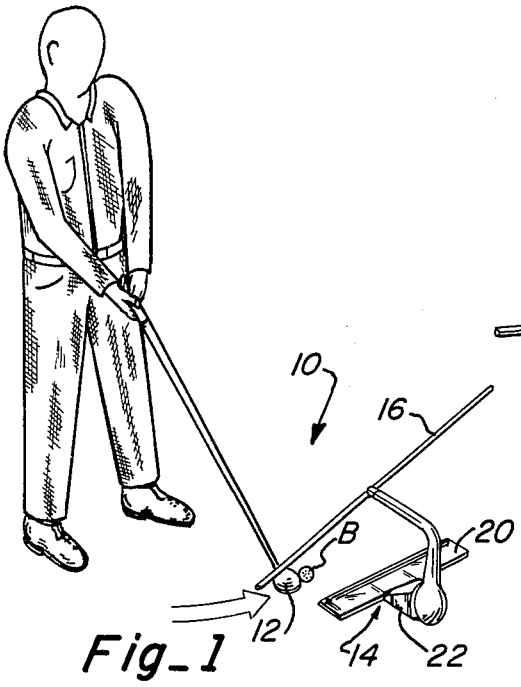
FIG. 1 is a perspective view of the golfing aid of the present invention when in use by a golfer.

Referring first to FIG. 1, the golfing aid device 10 of the present invention is shown being used by a golfer to assist the golfer in imparting movement to the club head 12 along an inside-out path prior to contact with the ball as indicated by the arrow. As will be appreciated, the golfing aid includes a base member 14, an elongated rod 16, and a support arm 18 connecting the rod 16 to the base 14.

The base member 14 of the golfing aid is seen to have a flat generally rectangular portion 20 and an enlarged protrusion 22 on the base which serves as the connection location for the support arm 18 so that the support arm can be moved between selected locations as desired. The flat portion 20 of the base has a straight side edge 24 having indicia in the form of an arrow 26 extending therealong which is adapted to be pointed toward the target of the golfer. Along the rear edge 28 of the flat portion of the base, a second arrow 30 points toward the side edge 24 and lies in perpendicular relationship to the side edge 24 to assist the golfer in placement of a golf ball and to help visually align the club head so that its perpendicular to the intended line of flight toward the target. The protrusion 22 on the base is substantially dome shaped and has a flat generally circular surface 32 on the back face thereof. The flat face 32 on the base forms approximately a 14° forwardly convergent angle with the side edge 24 of the base for a reason to be explained later.

The golfing aid 10 is preferably made of a molded plastic material and for this reason the base 14 is hollow and opens downwardly. As a necessity of the molding process for assistance in getting the base out of the mold, the flat circular face 32 of the protrusion 22 is inclined slightly relative to vertical as can be appreciated in FIG. 5. The particular configuration of the base establishes a very stable supporting surface so that the device is not easily disrupted from its normal position.

The support arm 18, in the preferred form, is a hollow member having a first leg portion 36 extending generally perpendicularly away from a line lying perpendicular to the side edge 24 of the base and passing through the connection of the base to the support arm and a second leg portion 38 extending perpendicularly to the first leg portion in a direction so as to protrude beyond the side edge 24 of the base. Adjacent the lower end of the first leg portion 36 of the supporting arm, a flattened area 40 on the arm slideably abuts the circular flat face 32 on the protrusion 22 and a fastener 42 in the form of a bolt, rivot or the like interconnects the arm 18 with the base so that the arm is rotatable about an axis lying perpendicular to the abutting faces 32 and 40 of the protrusion and support arm respectively. The support arm has a forwardly protruding rib 44, FIGS. 5 and 7, adjacent the upper surface of the protrusion 22 and this rib is adapted to be positioned between a pair of raised ribs 46 on the upper surface of the protrusion to retain the support arm in a first generally vertical position (FIGS. 1 through 5). An abutment rib 48 on the rear side of the protrusion 22 is adapted to abut and support the rib 44 on the support arm when the support arm is positioned in a second position wherein it lies in a substantially horizontal plane (FIGS. 8 and 9) to retain the arm in this position. As will become more clear later, the two positions of the support arm correlate with angular orientations of the elongated rod 16 which assist the golfer in one position in establishing the proper path of movement of the club head for tee-to-green shots and in the second position in establishing a proper putting stroke.

The hollow support arm 18 opens at 48, FIG. 5, through its upper distal end and is provided with two pair of diametrically opposed slots **50*a* and 50*b*, FIG. 6, adapted to selectively and releasably receive a pair of diametrically opposed protruding ribs 52 on a cylindrical connection shaft portion 54 of the elongated rod 16. The cylindrical connection shaft portion of the elongated rod 16 extends away from the rod at approximately a 76° angle and from a location which is spaced approximately two-fifths of the length of the rod from the trailing end thereof. The ribs 52 on the connection shaft 54 are inserted into one pair of slots 50a when the support arm is in its vertical position of FIGS. 2 through 5 so that the elongated rod 16 inclines upwardly and outwardly in a forward direction away from the golfer who is standing adjacent the side of the device as in FIG. 1 with the rod forming approximately a 14° angle with the horizontal and with the side edge 24 of the base. However, when the support arm 18 is pivoted to its generally horizontal position, illustrated in phantom lines in FIG. 2 and in solid lines in FIGS. 8 and 9, the ribs on the connection shaft are positioned in the second pair of slots 50*b* whereby the elongated rod 16 assumes a position in which it is parallel to the flat portion 20 and the side edge 24** of the base.

Accordingly, it will be appreciated that the elongated rod 16 can be easily moved from the first position of FIGS. 1 through 4 wherein the rod inclines upwardly and outwardly in a forward direction away from the golfer to the second position of FIGS. 8 and 9 wherein it lies parallel to the ground and to the front edge 24 of the base member.

Figure 2:
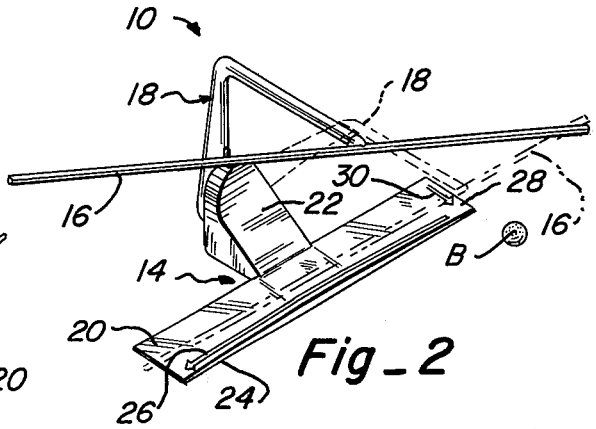
FIG. 2 is an enlarged perspective view of the golfing aid of FIG. 1 as viewed from the opposite side.
Figure 3:
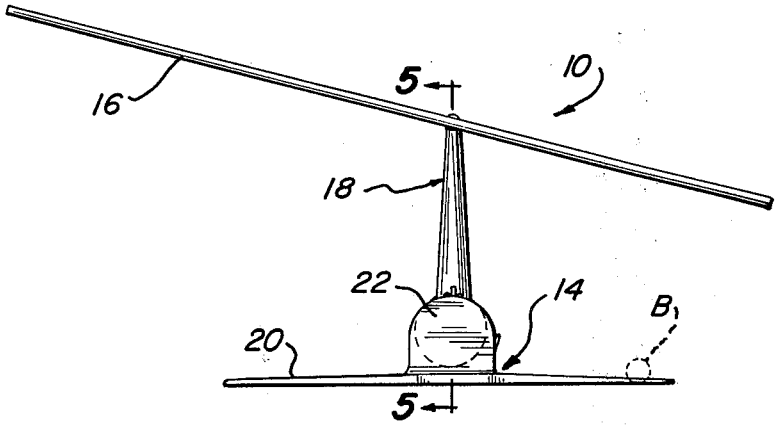
FIG. 3 is a further enlarged side elevation of the golfing aid of FIG. 1.
Figure 4:
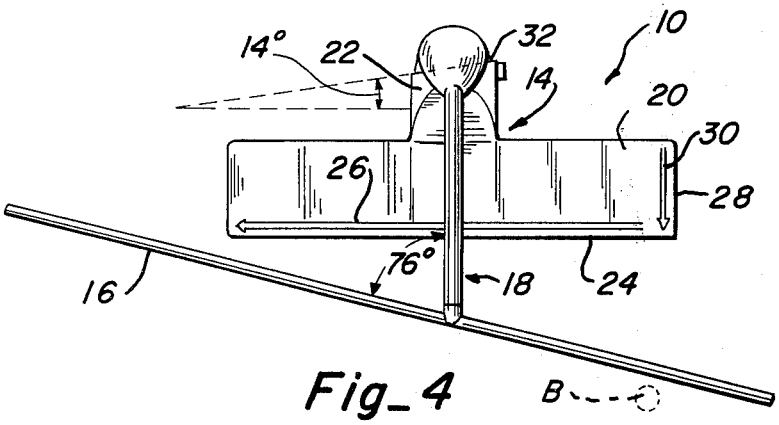
FIG. 4 is a top plan view of the golfing aid of FIG. 1.

In the position illustrated in FIGS. 1 through 5, and as best appreciated from FIGS. 2 through 4, the elongated rod 16 serves to mentally encourage the golfer to swing the golf club so that the club head 12 follows an inside-out path of movement at least until contact with the ball B, as illustrated by the arrow in FIG. 1, which is desirable for properly hitting the golf ball. Further, it has been found that proper weight distribution throughout the swing is more easily obtained by swinging along the path encouraged by the elongated rod. In other words, with the ball positioned at a location forwardly of the trailing end of the elongated rod as illustrated and at a position substantially beneath the rod 16, the golfer mentally perceives that the club head must follow an inside-out path of movement in order to make contact with the ball. If the club head follows an outside-in path of movement prior to contact with the ball the club head will contact the trailing end of the rod 16 and be deflected by the rod so that the club head will not engage the ball at all. Therefore, the device not only mentally suggests the proper path of movement for the club head but actually physically prevents the club head from contacting the ball if the club head follows an outside-in path of movement prior to reaching the ball.

Due to the 14° angular relationship of the back face 32 of the protrusion 22 relative to the side edge 24 of the base member, as the support arm 18 is rotated to its second position about its pivotal connection to the base, the second leg portion 38 of the support arm is moved into a generally horizontal position wherein it forms approximately a 76° angle with the side edge 24 of the base. Since the elongated rod 16 forms substantially a 76° angle with the second leg portion 38 of the support arm, in the second position it extends in a direction which is parallel to the side edge 24 of the base and at an elevation which is substantially level with the pivotal connection of the support arm 18 to the protrusion 22. Preferably, this is in a two to three inch range above the supporting surface so that a putter head can be moved beneath the rod and be physically prevented from being elevated to any substantial degree from the supporting surface during the putting stroke. Also, with the golf ball B positioned beneath the rod 16 along with the putter head the golfer can visually observe and maintain a perpendicular relationship between the face of the putter head and the intended line of putt, which extends in the direction in which the rod 16 is pointing, during the entire putting stroke.

It will be appreciated from the foregoing description that the golfing aid of the present invention is simple in design, can be easily and economically manufactured, and provides a two-fold function in assisting a golfer in developing an inside-out path of movement for the club head prior to impact with the ball for tee-to-green shots in developing a putting stroke wherein the putter head and remains in closely adjacent relationship with the putting surface and in perpendicular relationship with the intended line of putt throughout the entire stroke. It should be appreciated that in the preferred form, the elongated rod 16 is releasably secured in the distal end of the supporting arm 18 in any conventional manner so that when the elongated rod is contacted by a golf club which is traveling along an outside-in swing path, the rod will release from the support arm and be thrown forwardly so that the golfer will not be hurt and his club will not be damaged.

Although the present invention has been described with a certain degree of particularity, it is understood that the present disclosure has been made by way of example and that changes in details of structure may be made without departing from the spirit thereof.

What is claimed is:

1. A golfing aid adapted to assist a golfer in hitting a golf ball toward a preselected target with a golf club comprising in combination:

a base, a substantially straight elongated rod pointing along the intended line upon which said club is to be swung, support means interconnecting the base and the rod to retain the rod in an elevated position relative to the ground, and means permitting said rod to be selectively moved relative to said support means between a first use position wherein said rod is inclined upwardly and outwardly in a forward direction so as to point slightly outside a line extending from the aid to the golfer's target and a second use position wherein said rod extends parallel to the ground in closely spaced relationship with the ground.

2. The golfing aid of claim 1 wherein said rod in said first use position forms approximately a 14° angle with the line extending from the aid to the target of the golfer.

3. The golfing aid of claim 2 wherein said rod in said first use position forms approximately a 14° angle with horizontal.

4. The golfing aid of claim 1 wherein said base has a relatively straight edge thereon adapted to be pointed toward the golfer's target and wherein said support means is an arm which is pivotally connected to said base so as to be pivotal about a generally horizontal axis.

5. The golfing aid of claim 4 wherein said generally horizontal axis forms an angle of approximately 76° with said straight edge of the base.

6. The golfing aid of claim 4 further including positioning means on said base and support arm to selectively retain the relative positions of the base and support arm.

7. The golfing aid of claim 1 wherein said support means is an arm of generally L-shaped configuration with two leg portions, one of said leg portions protruding in a selected direction away from its connection to the base and the other leg portion extending substantially perpendicularly to the one leg portion so as to protrude beyond a side edge of the base, said rod being connected to said other leg portion at a position beyond said side edge of the base.

8. The golfing aid of claim 7 wherein said support arm is pivotally connected to the base.

* * * * *